US006186840B1

(12) United States Patent
Geltsch et al.

(10) Patent No.: US 6,186,840 B1
(45) Date of Patent: Feb. 13, 2001

(54) FEMALE CONNECTOR FOR ELECTRICAL CONNECTORS HAVING A CODING RIB

(75) Inventors: Hans Otto Geltsch, Rohr/Regelsbach; Harald Lutsch, RoBtal, both of (DE)

(73) Assignee: Framatome Connectors International, Courbevoie (FR)

( * ) Notice: Under 35 U.S.C. 154(b), the term of this patent shall be extended for 0 days.

(21) Appl. No.: 09/391,833

(22) Filed: Sep. 8, 1999

(30) Foreign Application Priority Data

Sep. 9, 1998 (DE) ..... 198 41 216

(51) Int. Cl.[7] ..... H01R 13/187
(52) U.S. Cl. ..... 439/843; 439/839; 439/748
(58) Field of Search ..... 439/843, 842, 439/839, 856, 852, 846, 884, 745, 746, 747, 748, 749

(56) References Cited

U.S. PATENT DOCUMENTS 4,938,720 * 7/1990 Romak ..... 439/839
5,749,752 * 5/1998 Kashiyama et al. ..... 439/744
5,941,741 * 8/1999 Dobblelaere et al. ..... 439/852
5,951,314 * 9/1999 Durand-Cochet et al. ..... 439/843

FOREIGN PATENT DOCUMENTS 196 30 939C1 12/1997 (DE) .
197 04 311A1 8/1998 (DE) .
0 600 419 A1 6/1994 (EP) .
WO 89/05531 6/1989 (WO) .

* cited by examiner

*Primary Examiner*—Paula Bradley
*Assistant Examiner*—Tho Dac Ta
(74) *Attorney, Agent, or Firm*—Perman & Green, LLP

(57) ABSTRACT

The present invention relates to a female connector (1) for electrical connectors having a sheet-metal frame (2) which is in the form of a box and has contact spring elements (3) and a connecting part (4) for a cable end, and having a reinforcing cage (5) which is attached via the sheet-metal frame, is in the form of a box and has a coding rib (6). The reinforcing cage (5) is folded from sheet steel such that the coding rib is formed by bending the metal sheet to form a profile having rounded edges, while avoiding outward-pointing sharp edges.

6 Claims, 2 Drawing Sheets

FEMALE CONNECTOR FOR ELECTRICAL CONNECTORS HAVING A CODING RIB

BACKGROUND OF THE INVENTION

The present invention relates to a female connector for electrical connectors having a sheet-metal frame which is in the form of a box and has contact spring elements and a connecting part for a cable end. The connector has a reinforcing cage attached to the frame and is in the form of a box with a coding rib.

Such female connectors are used in particular in systems in which up to 50 sockets are arranged in a corresponding socket housing in a connector. The dimensions of the female connectors typically have a cross section of 2×2 mm. In order to avoid female connectors being inserted into incorrect receptacles in the housing when a female connector housing is being fitted, coding aids are provided which, like a key bit, prevent an incorrect female connector from being inserted in a receptacle which is not intended for it. The simplest type of such a coding aid is a coding rib, which is fitted in the insertion direction on the reinforcing cage of a connector socket, and engages in a corresponding groove in the socket housing. The coding is provided by choosing the point at which the coding rib is arranged on the reinforcing cage. Furthermore, different forms of coding ribs are possible.

WO 89/05531 discloses a female connector for electrical connectors, whose reinforcing cage is composed of folded sheet steel, with the edges of the folded steel sheet meeting at one edge of the cage, which is in the form of a box, and with one of the edges being formed such that it projects somewhat, and thus forms the coding rib. This type of formation of a coding rib is disadvantageous to the extent that the cohesive nature of the reinforcing cage on the edge on which the sheet-metal edges abut can be ensured at the most by welding or bonding.

In the case of a female connector from the company OSRAM SYLVANIA, a coding rib which is similar to that in the case of the prior art mentioned above is produced, with the difference that the sheet-metal edge which projects vertically upwards in the prior art according to WO 89/05531 is moved to the adjacent side of the cage. This make it easier to connect the edges of the metal sheet of the reinforcing cage to one another. However, it results in a relatively broad and flat coding rib for this purpose, as a result of which it is not possible to prevent incorrect insertion into a receptacle not intended for this purpose in all circumstances. Furthermore, in the case of both the coding ribs described above, the cut edges of the metal sheet are exposed and can cut into the housing walls during insertion, while they "bite themselves in firmly".

SUMMARY OF THE INVENTION

The present invention is based on the object of further developing a female connector for electrical connectors having a sheet-metal frame which is in the form of a box and has contact spring elements and a connecting part for a cable end. The connector has a reinforcing cage which has a coding rib which can be used reliably irrespective of the connector type and irrespective of the nature of the contact elements used, without damaging the housing, and while allowing the cage edges to be attached to one another securely.

This object is achieved according to preferred embodiments of the present invention by providing a contact comprising: a sheet-metal frame which is in the form of a box having contact spring elements and a connecting part for a cable end. A reinforcing cage is attached to the sheet-metal frame. The reinforcing cage is formed in the form of a box from a folded metal sheet having four bending folds. The reinforcing cage has four sides joined by rounded edges formed by the bending folds and includes a coding rib in one of the sides. The side with the coding rib includes a first flap of the metal sheet having a longitudinal edge. The first flap overlaps a second flap of the metal sheet. The coding rib is formed by the overlapped flaps and has a rounded profile with no outwardly pointing sharp edge of the metal sheet. Preferably the coding rib has a curved arc cross-section.

The invention will be explained in more detail in the following text on the basis of the description of an exemplary embodiment, and with reference to the drawing, in which:

DETAILED DESCRIPTION OF THE INVENTION

Figure 1:
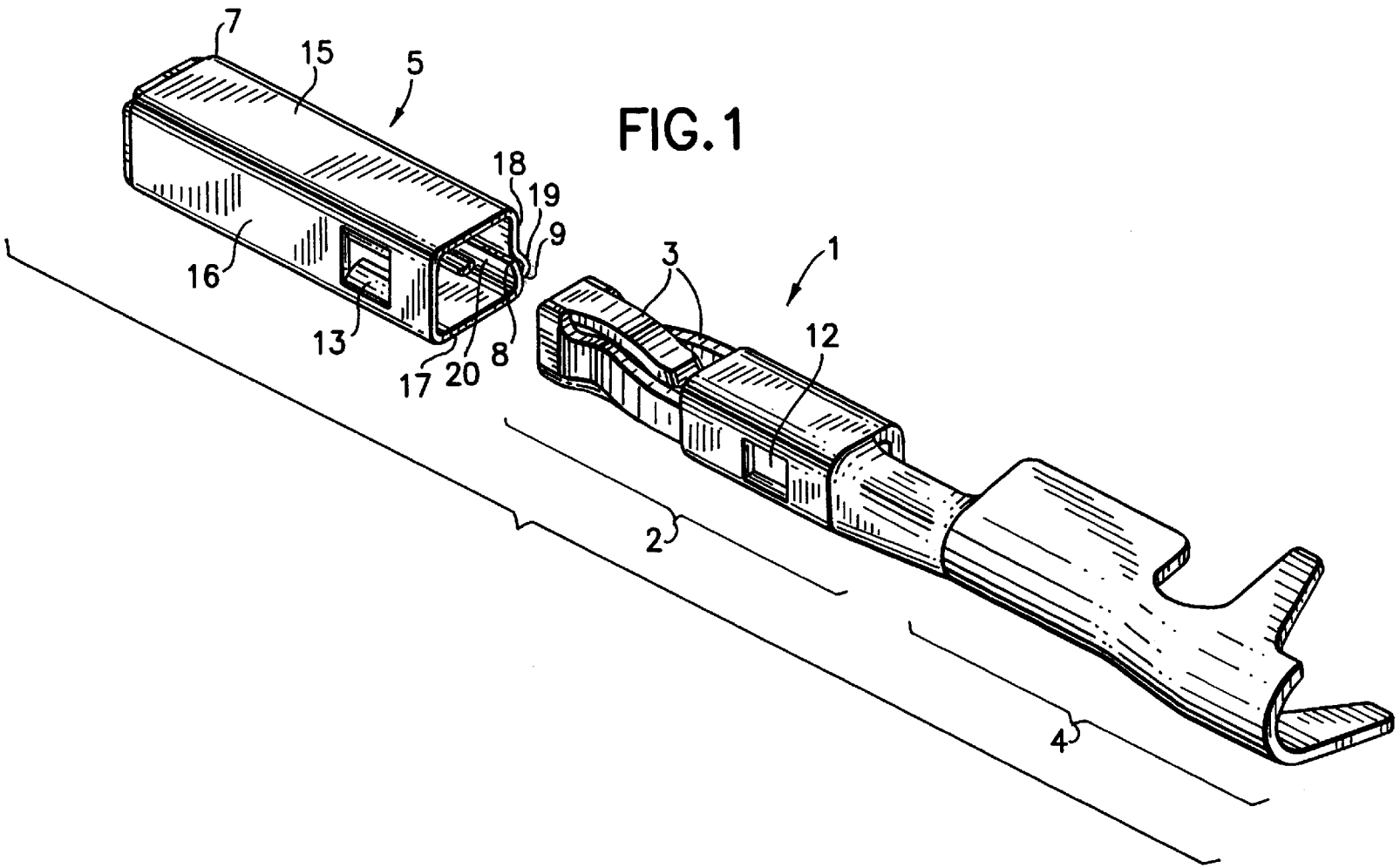
FIG. 1 shows a perspective view of a female connector whose reinforcing cage has been pulled off it.

FIG. 1 shows a female connector 1 having a sheet-metal frame 2 which is in the form of a box and has contact elements 3 and a connecting part 4 for a cable end, which is curved. A reinforcing cage 5 composed of a metal sheet such as steel is fixed on the sheet-metal frame 2 (which is in the form of a box) with the aid of openings 12 in the rear part of the sheet-metal frame 2 and lugs 13 in the rear part of the reinforcing cage 5, which engage in these openings 12.

Figure 2A:
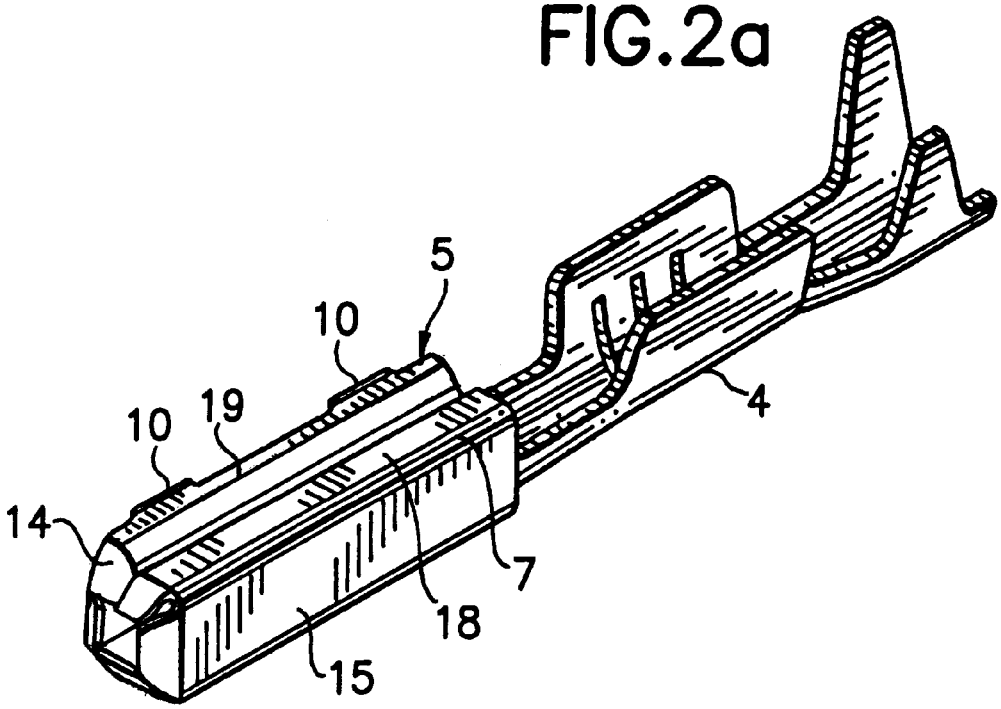
FIGS. 2*a* and *b* show two perspective views of the female connector according to the invention, with a coding rib.
Figure 2B:
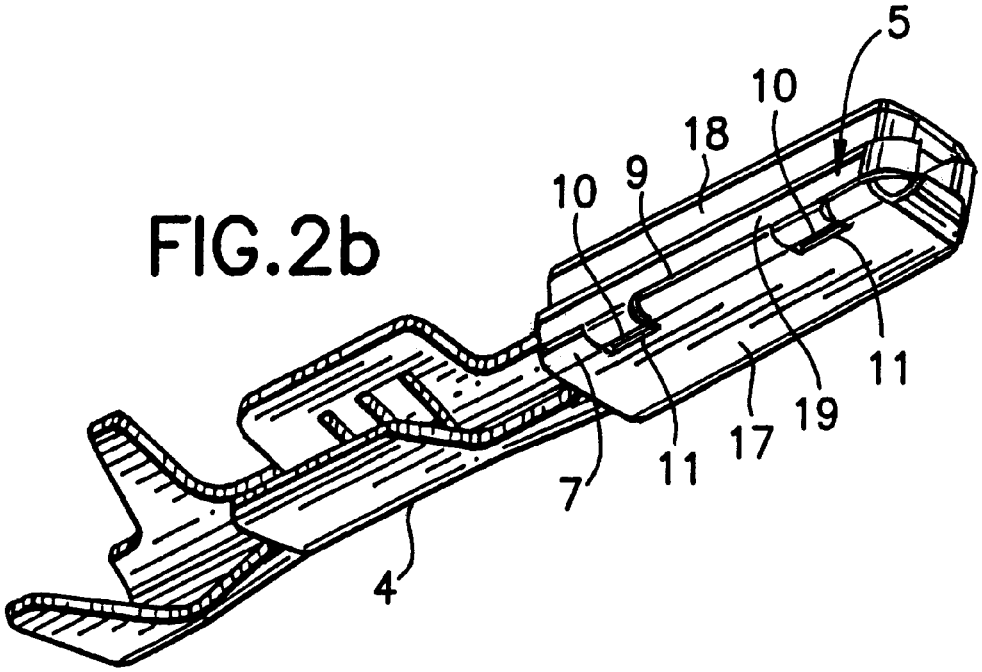

The reinforcing cage 5 surrounds the sheet-metal frame 2 which is in the form of a box. The reinforcing cage 5 is attached to the sheet metal frame. The reinforcing cage 5 is formed from a folded metal sheet having four bending folds 7. The cage 5 is in the form of a box having four sides 15, 16, 17 and 18. The sides 15–18 are joined by rounded edges formed by the bending folds 7. A coding rib 19 is provided in one of the sides 18 which includes a first flap 20 having a longitudinal edge 9 of the metal sheet which overlaps a second flap 21 of the metal sheet having a longitudinal edge 8. The coding rib 19 is formed by the overlapped flaps 20 and 21 and has a rounded profile with no outwardly pointing sharp edge 9 of the metal sheet. The sheet-metal edges 8 and 9 of the steel sheet (which is folded in the form of a box by means of folds 7 overlap one another outside the edges 7 on one side surface of the reinforcing cage 5. The sheet-metal flap 19 is bent around, and the cut edge 9 of the metal sheet points towards the inside of the cage. This prevents the sharp edge from cutting in the plastic in the connector housing. In the interior of the cage, the cage walls are all smooth, including the wall in which the sheet-metal edge is located, so that the cage does not require any specific sheet-metal frame arrangement or arrangement of contact elements. The second sheet-metal edge, which the first sheet-metal edge overlaps on the outside is domed in the form of an arc, in order in this way to form a coding rib which projects sufficiently. This is best seen in FIG. 2*a*. At the insertion end 14, the reinforcing cage is bent inwards in the region of the coding rib, in order to facilitate insertion into a corresponding receptacle. Attachment lugs 10 are fitted to the second sheet-metal edge 9 and engage in corresponding openings 11 on the first sheet-metal edge, in order in this way to attach the mutually abutting edges of the reinforcing cage to one another. The reinforcing cage is thus intrinsically robust, and ensures reliable insertion into the correspondingly shaped receptacle in the connector housing of a connector.

The embodiment of the present invention described above should not be regarded as any limitation, but is intended merely as an example of the invention described in the claims.

What is claimed is:

1. Female contact for electrical connectors, said contact comprising:

a sheet-metal frame which is in the form of a box having contact spring elements and a connecting part for a cable end; and a reinforcing cage which is attached to the sheet-metal frame, said reinforcing cage being formed from a folded metal sheet having four bending folds, said reinforcing cage being in the form of a box having four sides joined by rounded edges formed by said bending folds and including a coding rib in one of said sides, said one of said sides including a first flap having a longitudinal edge of the metal sheet which overlaps a second flap of the metal sheet, said coding rib being formed by said overlapped flaps and having a rounded profile with no outwardly pointing sharp edge of the metal sheet.

2. Female contact according to claim 1, wherein said coding rib has cross-section which is curved in an arc shape and wherein said contact includes an insertion end for inserting said contact in a cavity of a connector housing, and wherein the overlapping flap of said coding rib is bent inwards in a region of the insertion end, in order to facilitate insertion of said contact into the cavity.

3. Female contact according to claim 1 wherein one of said flaps has lugs, which engage in corresponding cutouts in the other flap, which are located in a region of one of the rounded edges of the reinforcing cage, to fix the cage in place on the frame.

4. Female contact according to claim 3, wherein said coding rib has a curved arc cross-section and wherein said contact includes an insertion end for inserting said contact in a cavity of a connector housing, and wherein the overlapping flap of said coding rib is bent inwards in a region of the insertion end, in order to facilitate insertion of said contact into the cavity.

5. Female contact according to claim 1 wherein said coding rib comprises a longitudinal fold in said overlapping flap, said longitudinal fold being formed in a region of said one of said sides of the cage which is spaced from said rounded edge.

6. Female contact according to claim 5 wherein the width of said coding rib is less than the width of said one side of said reinforcing cage.

* * * * *